US006472645B1

(12) United States Patent
Bohlender

(10) Patent No.: US 6,472,645 B1
(45) Date of Patent: Oct. 29, 2002

(54) AIR HEATING DEVICE

(75) Inventor: Franz Bohlender, Kandel/Pfalz (DE)

(73) Assignee: David & Baader Spezialfabrik Elekrischer Apparate und Heizwiderstande GmbH, Kandel/Pfalz (DE)

( * ) Notice: Subject to any disclaimer, the term of this patent is extended or adjusted under 35 U.S.C. 154(b) by 0 days.

(21) Appl. No.: 09/578,013

(22) Filed: May 24, 2000

(30) Foreign Application Priority Data

Jun. 15, 1999 (EP) ..... 99111605

(51) Int. Cl.[7] ..... H05B 1/02
(52) U.S. Cl. ..... 219/505
(58) Field of Search ..... 219/504, 505, 219/202, 530, 534, 535, 536, 538, 539, 540; 338/22 R, 225 D, 328, 329; 392/347, 360, 355, 379

(56) References Cited

U.S. PATENT DOCUMENTS

| | | | | | |
|---|---|---|---|---|---|
| 2,606,986 | A | * | 8/1952 | Sweger | 338/25 |
| 4,327,282 | A | * | 4/1982 | Nauerth | 219/541 |
| 4,814,584 | A | | 3/1989 | Bohlender et al. | 219/535 |
| 5,057,672 | A | * | 10/1991 | Bohlender et al. | 219/540 |
| 5,198,640 | A | * | 3/1993 | Yang | 219/530 |
| 5,218,336 | A | * | 6/1993 | Murakami | 338/328 |
| 5,377,298 | A | * | 12/1994 | Yang | 392/360 |
| 5,471,034 | A | * | 11/1995 | Kawate et al. | 219/485 |
| 5,562,844 | A | * | 10/1996 | Bohlender et al. | 219/540 |
| 5,665,261 | A | * | 9/1997 | Damsohn et al. | 219/504 |
| 5,854,471 | A | * | 12/1998 | Tadokoro et al. | 219/540 |
| 5,995,711 | A | * | 11/1999 | Fukuoka et al. | 392/347 |

FOREIGN PATENT DOCUMENTS

| | | | |
|---|---|---|---|
| DE | 197 06 199 A1 | 8/1998 | H05B/3/40 |
| EP | 0 379 873 A2 | 1/1990 | H05B/3/14 |
| EP | 0 521 181 A1 | 7/1991 | H05B/3/14 |
| EP | 0 575 649 A1 | 6/1992 | F24H/3/04 |

* cited by examiner

*Primary Examiner*—Sang Paik
(74) *Attorney, Agent, or Firm*—Michael Best & Friedrich LLP

(57) ABSTRACT

The present invention relates to a heating device for heating air and to radiator subassemblies and positioning frames and further relates to a method for mounting a heating device according to the invention. The positioning frames comprise means for snap-fittingly anchoring radiator elements and electrode sheets, thereby permitting an easy joining to obtain radiator subassemblies which can subsequently be arranged in layers or stacked in an easy manner. A heating device is thereby created with improved assembling properties. PTC elements are used as the heating elements.

42 Claims, 9 Drawing Sheets

AIR HEATING DEVICE

BACKGROUND OF THE INVENTION

1. Field of the Invention

The present invention relates to a heating device for heating air and to a method for mounting the same. Further, the invention relates to radiator subassemblies and positioning frames that form a part of the heating device. In particular, the present invention relates to heating devices that comprise PTC elements.

2. Description of the Related Art

In automotive vehicles, in particular those having economically operating optimized internal combustion engines, heating devices or radiators are used for heating the passenger compartment and the engine. Heating devices, however, are also suitable for other purposes in a wide area of applications, e.g. in the field of building installations (room air conditioning), industrial plants, or the like.

Presently, several techniques have been developed in the field. In EP 0 575 649 B1 by Bohlender et al. a radiator is disclosed which contains heating elements that are assembled to form prefabricated units consisting of sheet bands which are riveted to each other and which enclose a lamella band. The PTC elements used are held in windows or openings of plastic frames. For mounting purposes the prefabricated heating element units and the plastic frames provided with PTC elements are stacked and fixed by means of a holding frame. Such a type of construction has the significant drawback that the assembly of such a radiator is troublesome.

DE 197 06 199 A1 describes an electric heating unit in which heating elements are stacked that carry PTC elements and comprise corrugation ribs. To secure the position of the corrugation ribs between the heating elements, projections are used on the sheets that enclose the PTC elements. Such technique does again not lead to an easy assembly of the heating unit in its entirety because the heating elements and the corrugation ribs must still be stacked subsequently and individually.

EP 0 379 873 A2 by Starck describes a device for heating gases using PTC elements that are fixed in a frame part which is disposed inside of a U-shaped profile member and which is covered by a cover plate. For enabling heat transfer to the surrounding air the arrangement has lamellae thereon fixed in a non-positive manner that are provided with an opening for this purpose. Although heating units are thereby created which have clampingly seated thereon heat discharge lamellae, such a device can only be mounted under great efforts because the lamellae must be slid thereonto individually. Moreover, the arrangement is not very stable, nor can it be stacked easily.

SUMMARY OF THE INVENTION

The present invention therefore has been made in consideration of the above situation, and has as its primary object to provide a heating device, a radiator subassembly and a positioning frame with improved mounting characteristics as well as a method for mounting such a heating device.

It is another object of the present invention to reduce the weight of the device and the production costs.

Another object of the present invention is to improve the technique of electrically connecting the heat elements to the power supply.

It is still another object of the present invention to allow for mounting radiator elements of a great length as well as heating elements having a great heat output.

Another object of the present invention is to increase mechanical and thermal stability of the overall arrangement.

To achieve these objects, according to a first aspect of the present invention, there is provided a heating device for heating air, wherein the heating device comprises at least one radiator element and at least one positioning frame. Said at least one positioning frame is arranged for being fixed to said at least one radiator element. Said at least one positioning frame comprises means for receiving at least one PTC (Positive Temperature Coefficient) element. Said at least one positioning frame further comprises means for clipping a radiator element to at least one side of the positioning frame.

According to a second aspect, the invention provides a method for assembling a heating device, wherein the method comprises the steps of connecting radiator sheets to lamella elements for prefabricating radiator elements; clipping the prefabricated radiator elements and/or electrode sheets to positioning frames and inserting PTC elements for prefabricating radiator subassemblies; stacking the prefabricated radiator subassemblies; and enclosing the stacked radiator subassemblies in a holding frame.

According to a third aspect of the present invention, there is provided a positioning frame comprising means for receiving at least one PTC (Positive Temperature Coefficient) element; and means for clipping a radiator element to at least one side of the positioning frame.

According to a fourth aspect, the invention provides a radiator subassembly comprising a radiator element and a positioning frame clipped to the radiator element. The positioning frame comprises means for receiving at least one PTC (Positive Temperature Coefficient) element.

BRIEF DESCRIPTION OF THE DRAWINGS

The accompanying drawings are incorporated into and form a part of the specification to illustrate several embodiments of the present invention. These drawings together with the description serve to explain the principles of the invention. The drawings are only for the purpose of illustrating preferred and alternative embodiments of how the invention can be made and used and are not to be construed as limiting the invention to only the illustrated and described examples. Further features and advantages will become apparent from the following and more particular description of the various embodiments of the invention, as illustrated in the accompanying drawings, wherein.

DETAILED DESCRIPTION OF THE INVENTION

The illustrative embodiments of the present invention will be described with reference to the figure drawings wherein like elements and structures are indicated by like reference numbers.

Figure 1:
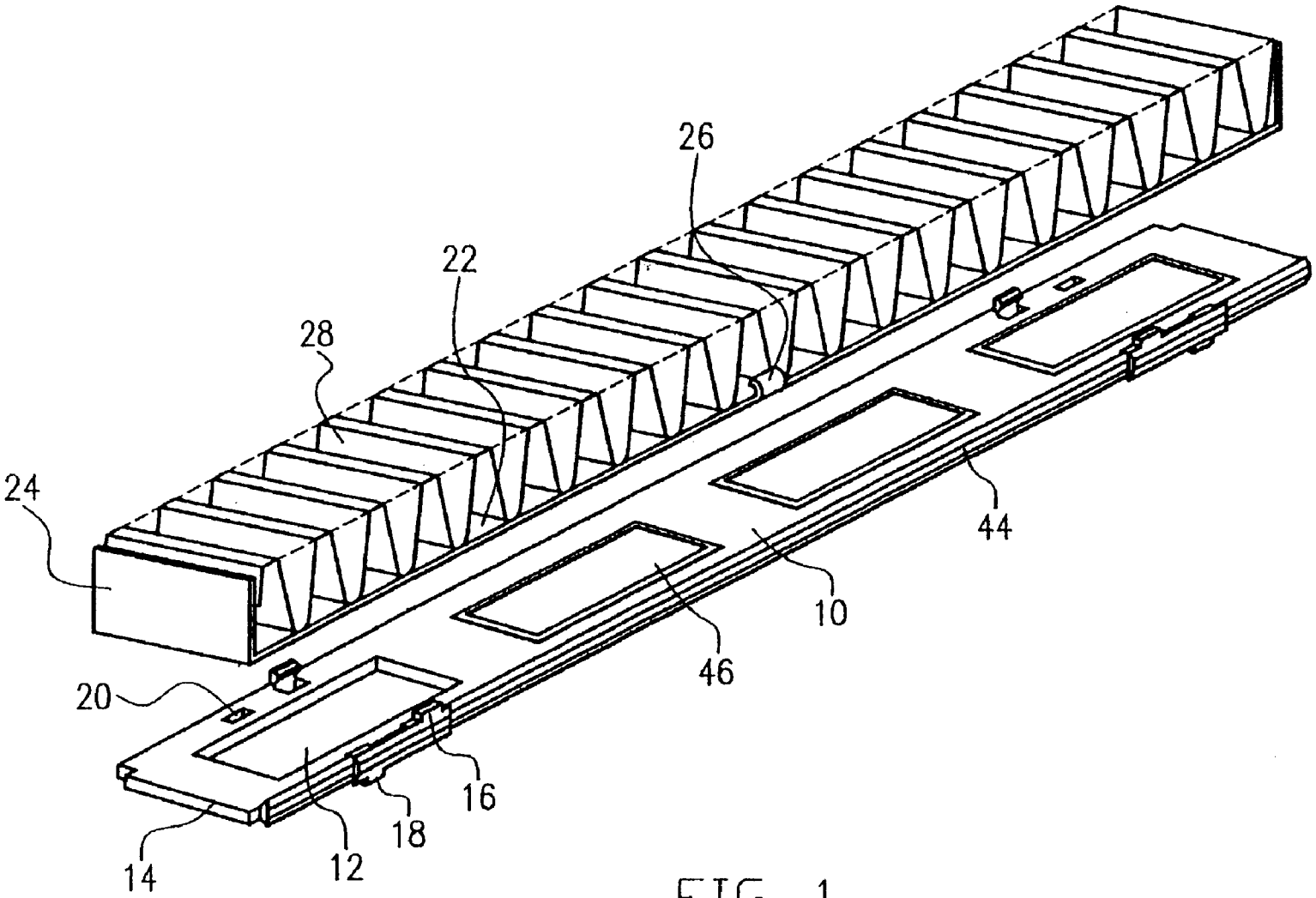
FIG. 1 illustrates a positioning frame and a radiator element according to a first embodiment of the present invention.

The positioning frame shown in FIG. 1 comprises four recesses 12 for receiving PTC elements 46. The number of the PTC elements in each positioning frame can differ from the illustration of FIG. 1 and assume any desired values; in particular, a positioning frame may also comprise six PTC elements. The recesses are preferably in the form of openings or penetrations, but may also be designed as hollows.

The positioning frame consists preferably of plastics, such as polyamide, and may be glass fiber-reinforced for achieving an increased mechanical stability.

Since low-voltage PTC elements with an operating voltage of e.g. 12 V have a thickness of 1.4 mm or even only 1.1 mm, the positioning frames according to the preferred embodiment are manufactured near the recesses provided for the PTC elements at a thickness which is at least 0.1 mm smaller than the PTC thickness.

According to a preferred embodiment the length of a positioning frame is about 240 mm.

At its side edges 44 the positioning frame 10 comprises bulges which permit a noiseless air flow. Moreover, the front edges 14 may have hunched bulges at both sides of the positioning frame, which are not shown in FIG. 1.

Furthermore, the positioning frame comprises clip elements having noses 16, 18 and recesses 20. In the preferred development of FIG. 1, the positioning frame has four of such clip elements, but the number of said clip elements may also differ therefrom.

Preferably, each clip element comprises two oppositely directed noses 16, 18 that are arranged to match recesses 20. Like the positioning frame itself, the clip elements are preferably made from plastics, such as polyamide. The preferred manufacturing process is here an injection molding process.

Radiator elements are snap-fittingly anchored by means of the clip noses to the positioning frame. Such a radiator element in a first embodiment is shown in FIG. 1 and consists of a radiator sheet 22 and a lamella element 28 in the form of corrugation ribs. At its front ends the radiator sheet 22 has lamella terminating borders 24 which define the length of the corrugation rib element. Furthermore, the radiator sheet 22 is centrally provided at its side edges with a respective crimp lug 26 for fixing the lamella element 28.

Preferably, the radiator element has about the length and width of the positioning frame and a preferred height of about 10 mm. The crimp lugs 26 have a width of 3 mm in a preferred development.

The radiator sheet and the corrugation ribs are preferably made of aluminum which is resistant to corrosion and exhibits a high thermal conductivity. In an alternative embodiment the radiator sheet may also be made from brass.

As an alternative to the fastening possibility offered between radiator sheet and lamella element by crimp lugs, a partial laser welding operation can also be carried out.

Figure 2:
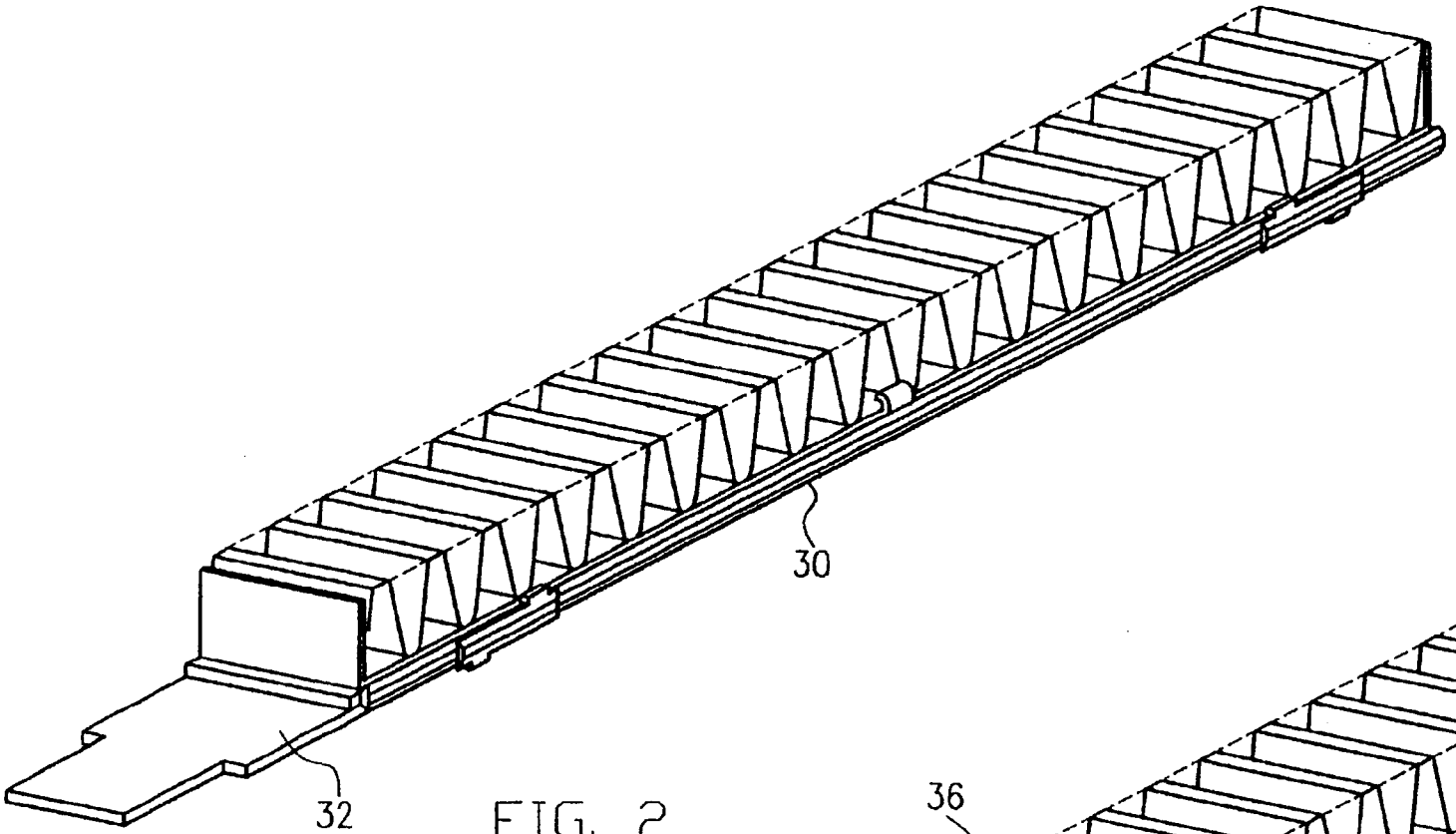
FIG. 2 illustrates a positioning frame with the radiator element of the first embodiment being snapped or clipped to one side, and an electrode sheet of a first embodiment clipped to the other side of the positioning frame.

FIG. 2 shows a prefabricated radiator subassembly in which the positioning frame shown in FIG. 1 is clipped to the radiator element shown in FIG. 1 and an electrode sheet 30 is additionally snapped to the frame at the other side thereof. Moreover, the electrode sheet 30 is provided at a front side with a terminal lug 32 with which an electrical connection can be established in an advantageous manner. The electrical connections of the heating elements may be formed as welding connections and also as plug-type connections on the electrode sheet. Since no rivet connections are used, it is possible to supply the current up to a high value. For instance, a current of 160 A may be utilized.

Differing from the design shown in FIG. 2, a positioning frame may be connected to lamella elements at both sides. Furthermore, it is possible to provide a positioning frame at both sides with the same or different electrode sheets. Moreover, electrode sheets can be connected without a positioning frame to lamella elements at the upper side thereof.

Figure 3:
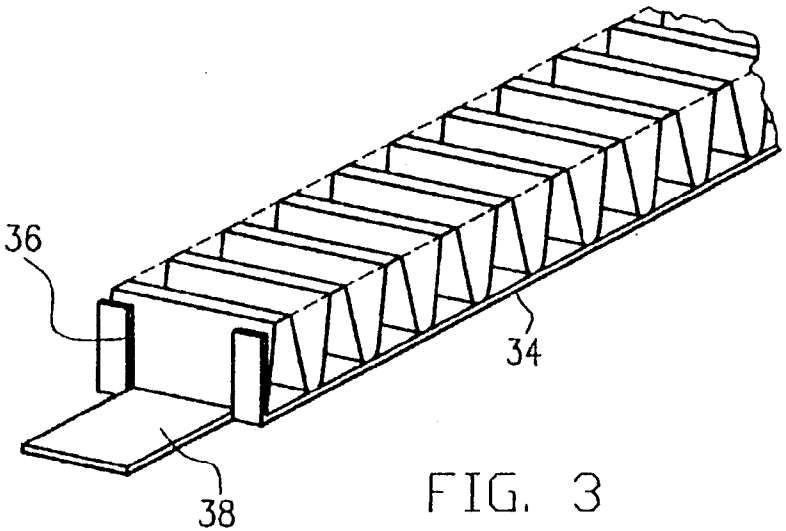
FIG. 3 illustrates a second embodiment of a radiator element according to the present invention.

FIG. 3 shows a further development of a radiator element in which the radiator sheet 34 also performs the function of an electrode sheet. To this end the lamella terminating border 36 is integrally connected to an electric terminal lug 38.

Figure 4A:
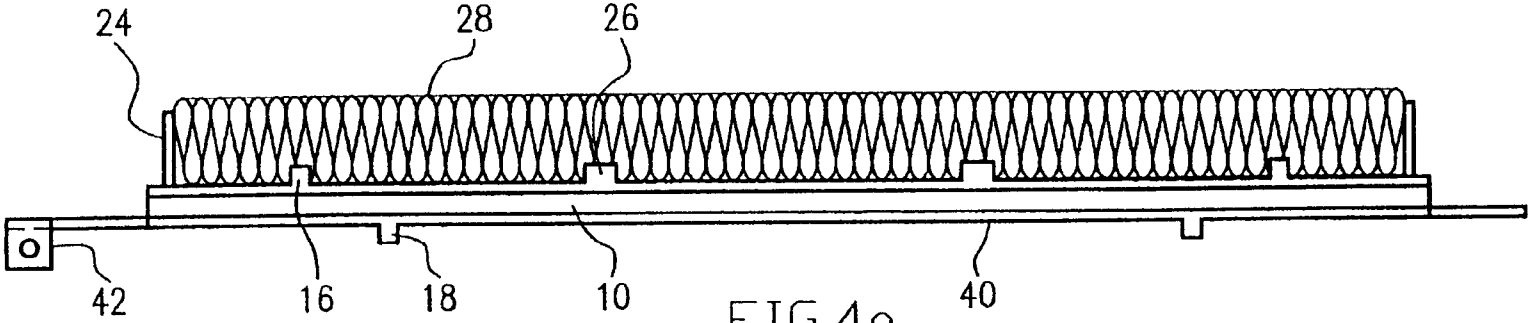
FIG. 4*a* is a side view of a radiator subassembly consisting of a positioning frame, a radiator element of a third embodiment and an electrode sheet of a second embodiment.
Figure 4B:
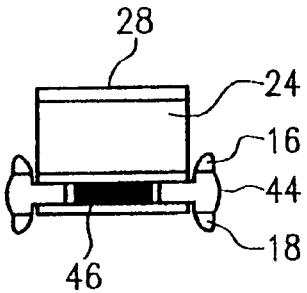
FIG. 4*b* is a front view showing a radiator subassembly consisting of a positioning frame and a radiator element.
Figure 4C:
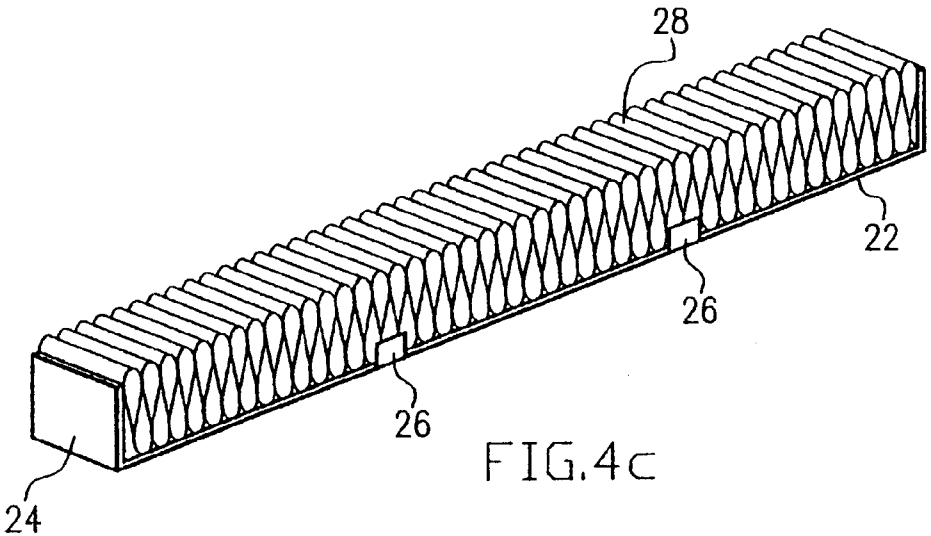
FIG. 4*c* shows the third embodiment of the radiator element.

FIG. 4*a* shows an arrangement similar to the one illustrated in FIG. 2, but in which the corrugation ribs of the lamella element 28 are placed closer to each other. Moreover, the radiator sheet of the radiator element has two crimp lugs 26 at each side edge. Moreover, the electrode sheet is provided with a bent terminal lug. The arrangement of FIG. 4*a* without a bent terminal lug can be seen in FIG. 4*b* in a front view. FIG. 4*c* shows the radiator element of FIG. 4*a* in a separate illustration.

Figure 5:
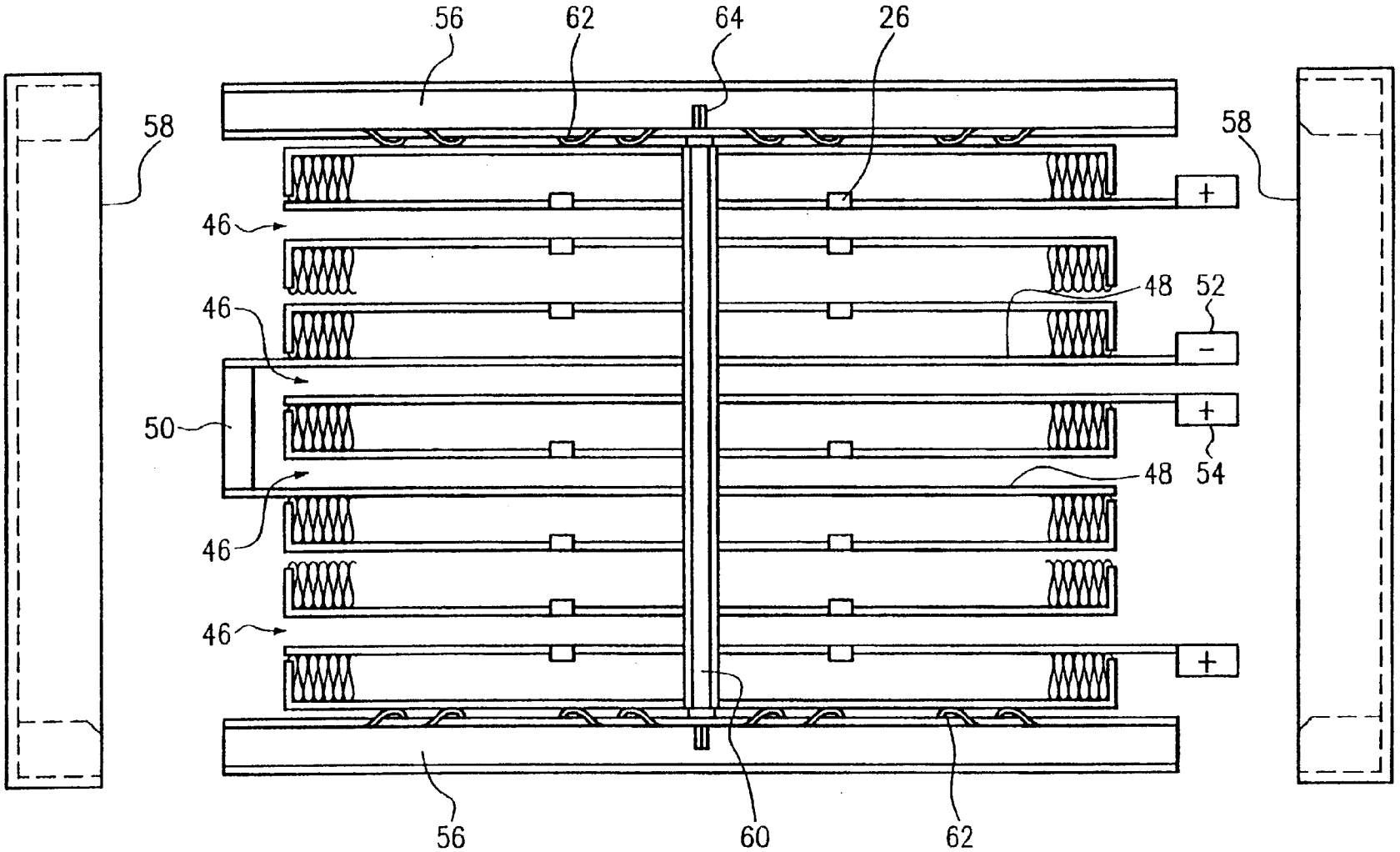
FIG. 5 illustrates a heating device of a first embodiment of the present invention.
Figure 6A:
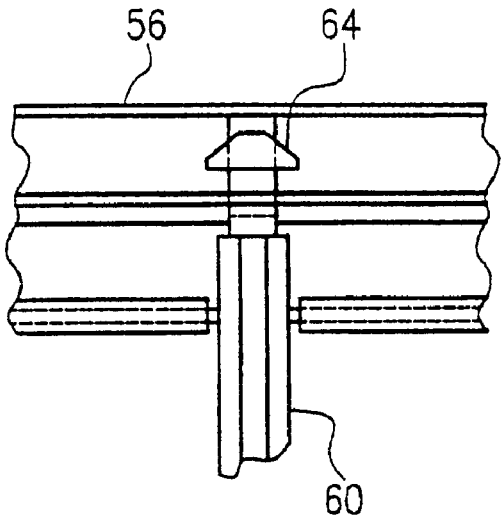
FIGS. 6*a* and 6*b* are side and front views illlustrating the joining technique between holding bar and spring bar by means of a holding lug.
Figure 6B:
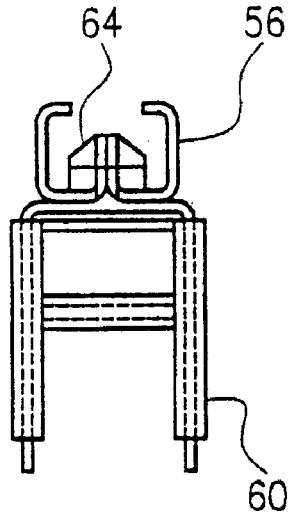
Figure 6C:
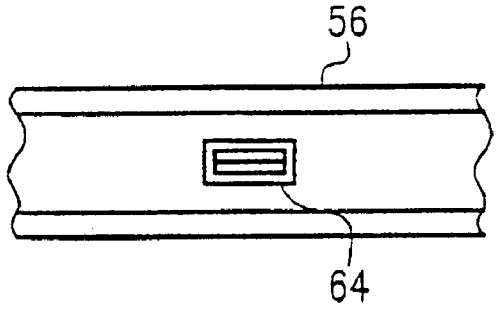
FIGS. 6*c* and 6*d* are top views illustrating the rotatability of the holding lug.
Figure 6D:
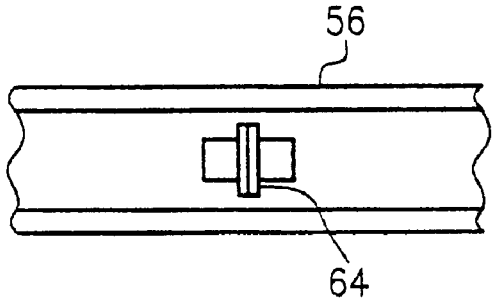

FIG. 5 shows a first development of the heating device according to the invention. The device consists of a layered or stacked arrangement of prefabricated radiator subassemblies forming a total of three heating modules. A total output of 1000 W is preset in this embodiment. Other developments have PTC elements with a total output of up to 2,000 W.

In the embodiment of FIG. 5, the outer heating modules have only one PTC row whereas the central heating module comprises two PTC rows. The terminal lugs 54 provided with a "+" sign are the electric power supplies of the individual heating modules whereas the terminal lug 52 marked with the "−" sign represents the connection to ground.

To permit a flexible positioning of the radiator subassemblies the heating device of FIG. 5 has a two-part electrode sheet the two sheets 48 of which are connected by means of a bridge 50.

The stacked radiator subassemblies are enclosed at both sides by spring bars 56, with springs 62 between the bars and the upper and lower radiator subassembly, respectively, providing the necessary high resilient force. Spring bars are particularly useful in positioning frames which enclose four or more PTC elements. Moreover, in the case of particularly long spring bars, there is provided a preferably centrally mounted holding bar 60 which is preferably made from stainless steel and electrically insulated. At its ends the holding bar 60 comprises rotatable holding lugs 64 which for mounting purposes are inserted through suitable, preferably rectangular openings in the spring bars 56 and are rotated by 90° after pressure has been exerted on the spring bars. At the side, the spring bars 56 are additionally stabilized by side bars 58 which are preferably made from plastics.

FIGS. 6*a* to 6*d* illustrate in detail the joining technique employed between holding bar 60 and spring bar 56 by means of the rotatable holding lug 64. The holding lug 64 is here rotated by means of a rotating cylinder by about 90° at its upper part comprising transverse noses. Holding bar and spring bar are preferably manufactured as U-shaped hollow profiles. A cross-section of about 5×0.5 mm is preferred for the holding bar.

Figure 7:
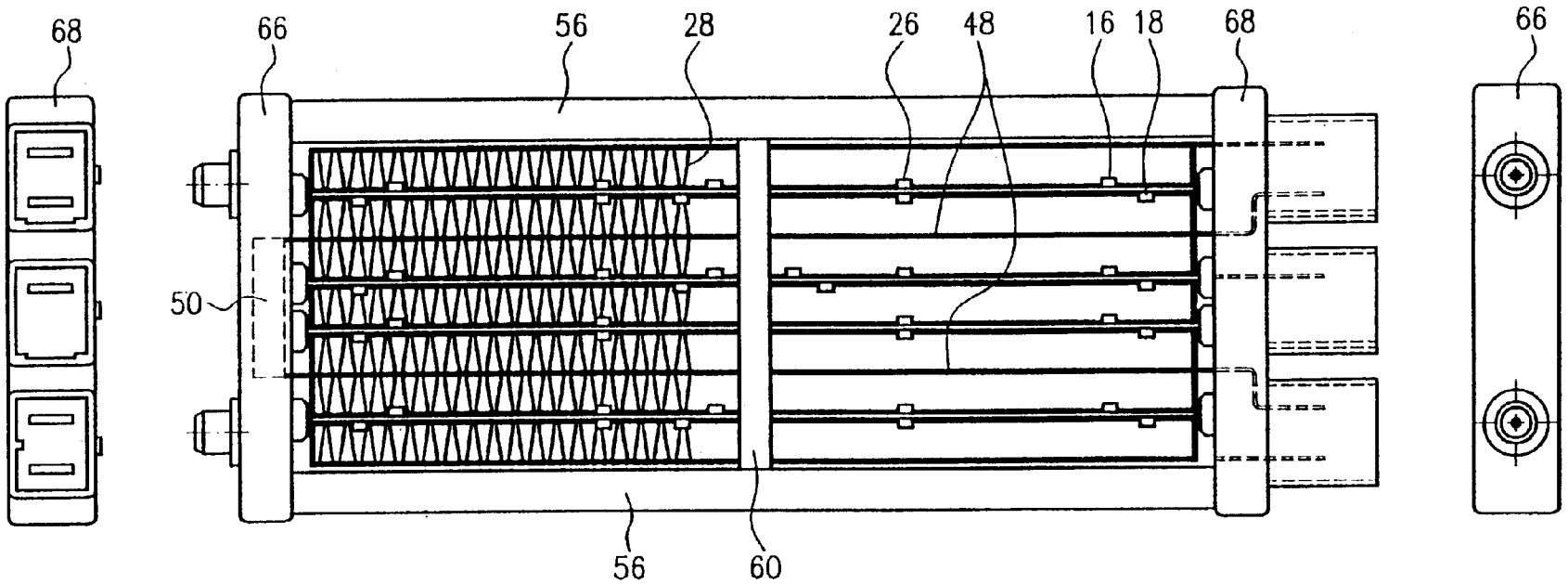
FIG. 7 shows a second embodiment of the heating device according to the present invention.

FIG. 7 shows a second development of a heating device according to the invention, the development mainly differing from the embodiment shown in FIG. 5 by the number and type of radiator subassemblies. Moreover, the side bars 66, 68 are provided with suitable mechnical as well as electrical mountings.

Figure 8:
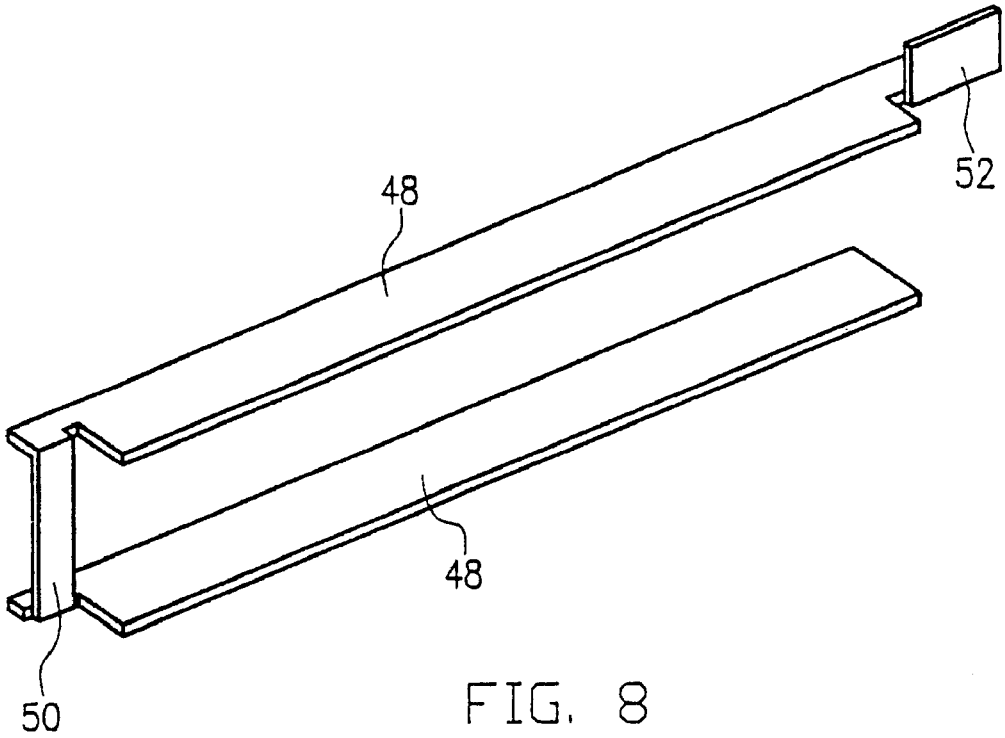
FIG. 8 illustrates a two-part electrode sheet according to the present invention.

FIG. 8 is a perspective view showing a two-part electrode sheet 48 with a connecting bridge 50 and a bent terminal lug 52. The two-part electrode sheet is particularly intended for assemblies in which use is made of only one ground or power-supply connection.

As becomes apparent from the above, the design of the positioning frame according to the invention effects an easier mounting of heating devices. Radiator subassemblies are first of all formed in that positioning frames are connected to radiator elements and/or electrode sheets to the extent required for the heating device. Radiator elements may also be connected to one another. Furthermore, use can be made of different radiator elements that differ, for example, in the shape of the radiator sheets and can also perform the functions of electrode sheets.

The prefabricated radiator subassemblies are then stacked and enclosed by spring bars. In a preferred embodiment only one or several holding bars are mounted. Finally, the entire assembly is fixed by side bars.

As described from the foregoing, the present invention has many advantages in that a positioning frame is used which makes it possible to clip or snap radiator elements onto positioning frames, i.e. to snap-fittingly connect the elements to the frames, whereby prefabricated units are obtained that can be handled easily without any special care. Since these prefabricated units also comprise the radiator elements, the number of the parts required for mounting the heating device is reduced. These few prefabricated radiator subassemblies can subsequently be stacked rapidly and by hand. The invention is thus of particular advantage in the case of thin PTC elements that have a thickness of about 1.1 mm and require special manual care in conventional assemblies.

Figure 9A:
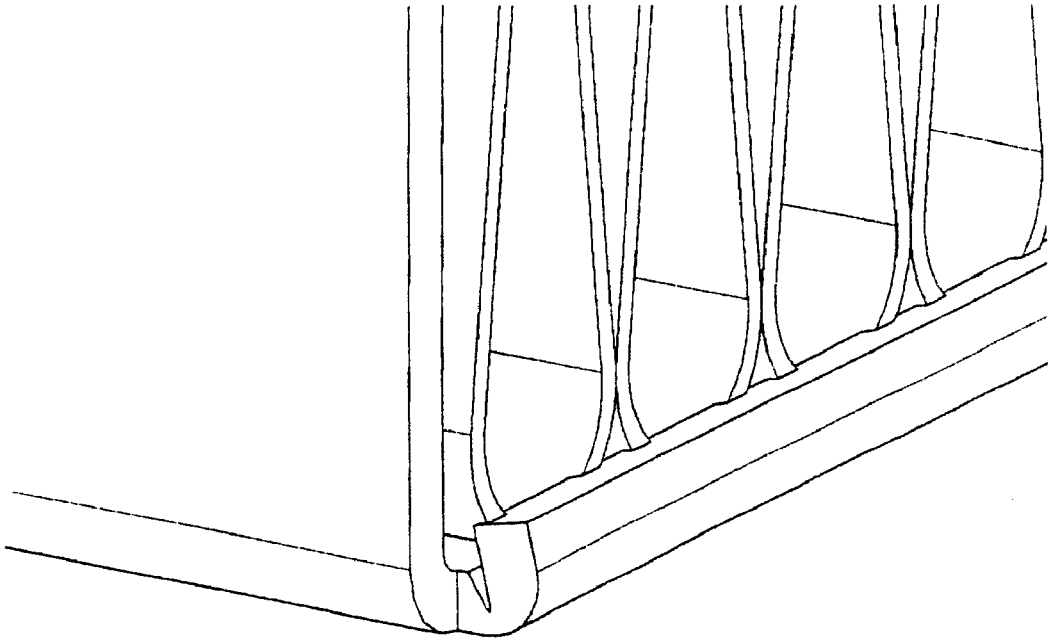
FIGS. 9*a* and 9*b* illustrate an alternative technique of connecting a radiator sheet and a lamella element according to another preferred embodiment of the present invention.
Figure 9B:
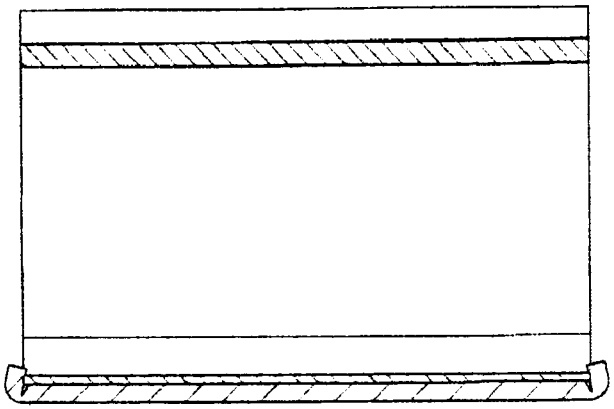
Figure 10:
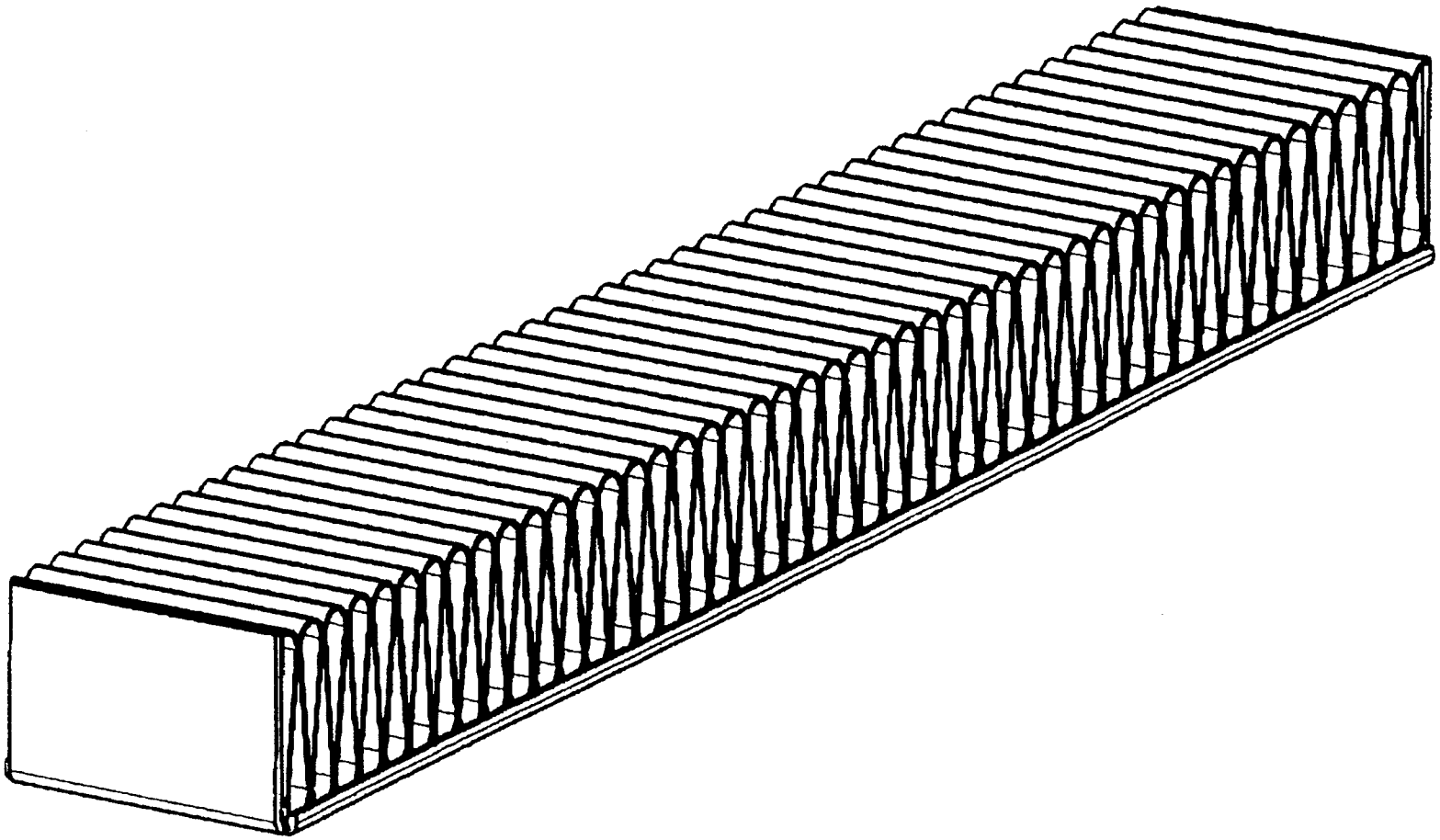
FIG. 10 illustrates the radiator element of the embodiment of FIGS. 9*a* and 9*b*.

While in the above embodiments the radiator sheet 22 is provided at its side edges with a respective crimp lug 26 for fixing the lamella element 28 other techniques may likewise be used. As for instance depicted in FIGS. 9 and 10, the edges of the radiator sheet may be turned up such that the lamella element can be fixed without provision of crimp lugs.

A further advantage of the assembly according to the present invention is that no rivet connections are needed because of the snap-fitting anchorage of the radiator element. Rivet connections in current-conducting parts lead to a transition resistance which may cause failure of a heating element. In particular, rivet connections consisting of different materials pose problems. The invention is therefore of particular advantage to heating elements having a great heat output (1,500 W, 12 V/125 A), in the case of which the manner of how the current is fed in is of special importance. Likewise the elimination of rivet connections is particularly advantageous in heating elements with only one connection to ground because in corresponding conventional arrangements the entire heating current is supplied via a single rivet connection.

Additionally, the clipping technique according to the present invention is of particular advantage to very large heating elements that require several radiator elements of a great length.

As will be appreciated by those of ordinary skill in the art, there are many further advantages provided by the specific examples given above in connection with the present invention. For instance, clip noses and corresponding recesses in the positioning frame permit a position-safe and non-rotational mounting of the radiator element. Further, the specific construction of the positioning frame in which the radiator elements are clipped from two sided simplifies the mountability because the total number of the members required for mounting the heating device is further reduced. The possibility of clipping electrode sheets, instead of radiator elements, to one side or both sides allows the prefabrication of many different radiator subassemblies and further enhances the suitability for mounting.

The provision of the electrode sheets with terminal lugs permits a great number of connection techniques for current input. Here, bent terminal lugs are of most advantage to both welding connections and plug-type connections. The use of two-part electrode sheets which are connected via a bridge additionally simplifies the overall mounting of the heating device due to the provision of particularly large prefabricated radiator subassemblies and further permits the joining of electrical connections for several positioning frames.

Moreover, as discussed in more detail before, there are openings provided in the positioning frame for holding the at least one PTC element. This advantageously reduces the production costs of the positioning frame and additionally helps to reduce its weight.

As will be appreciated in utilizing the invention, where the positioning frame is provided at its front sides with bulges, the positional stability of the radiator elements is thereby further enhanced. Moreover, bulges at the front side and the side edges of the positioning frame advantageously effect a noiseless guidance of the air flow. When the positioning frame is made from glass fiber-reinforced polyamide, the advantages of high stability and high temperature stability are combined with the advantageous characteristics of a precise manufacturability and small thermal expansion.

Of advantage are also the radiator elements of the preferred embodiment of the present invention, which are formed from a radiator sheet and a lamella element because the shape of the lamella elements in the form of corrugation ribs can be produced at low costs, leads to a small total weight and permits heat flow to the air going therethrough in a particularly advantageous manner because of the channels formed thereby and the large surface of the lamella elements. The radiator sheets are advantageously connected to the respective lamella elements by means of crimp lugs which are bent during manufacture. This permits the assembly of the radiator elements without additional and troublesome manufacturing procedures.

Advantages are also involved in the provision of the lamella terminating borders of the radiator sheets because the lamella elements are limited in their longitudinal extension.

Further, if such lamella terminating border is provided with an electric terminal, this will have the particular advantage that the radiator sheet can be used in a simple way in addition to current conduction, which further enhances the possibility of combining prefabricated subassemblies during assembly of the heating device.

When the prefabricated subassemblies are enclosed in a holding frame consisting of spring bars and side bars, the final assembly of the heating device is considerably facilitated thereby in an advantageous manner. In particular, a heating device is created which can largely be produced without any troublesome screw or rivet connections.

Springs which are connected to the spring bars result in a particularly suitable manner in an arrangement that is per se stable and whose elements are positioned in a displacement-proof manner. The operational reliability is also enhanced because the contact pressure required for contacting the PTC elements is always ensured.

An additional holding bar will further stiffen the total assembly, thereby permitting the use of further increased spring forces in an advantageous manner. When the holding bars are fixed in the spring bars by means of rotatable holding lugs, this offers the advantage of an again improved assembling technique.

While the invention has been described with respect to the preferred physical embodiments constructed in accordance therewith, it will be apparent to those skilled in the art that various modifications, variations and improvements of the present invention may be made in the light of the above teachings and within the purview of the appended claims without departing from the spirit and intended scope of the invention. In addition, those areas in which it is believed that those of ordinary skill in the art are familiar, have not been described herein in order to not unnecessarily obscure the invention described herein. Accordingly, it is to be understood that the invention is not to be limited by the specific illustrative embodiments, but only by the scope of the appended claims.

What is claimed is:

1. Heating device for heating air, the heating device comprising at least one radiator element and at least one positioning frame; said at least one positioning frame arranged for being fixed to said at least one radiator element; said at least one positioning frame comprising means for receiving at least one PTC (Positive Temperature Coefficient) element; said at least one positioning frame further comprising means for clipping a radiator element to both sides of the positioning frame.

2. The heating device as claimed in claim 1, wherein said clipping means comprises at least one clip nose.

3. The heating device as claimed in claim 1, wherein the clipping means is also arranged for clipping to an electrode sheet.

4. The heating device as claimed in claim 3, wherein said electrode sheet comprises a terminal lug.

5. The heating device as claimed in claim 4, wherein the terminal lug is bent by substantially 90°.

6. The heating device as claimed in claim 3, wherein said electrode sheet is connected to a second electrode sheet via a bridge, thereby forming a two-part electrode element.

7. The heating device as claimed in claim 1, wherein said means for receiving at least one PTC element comprises at least one opening in the positioning frame.

8. The heating device as claimed in claim 1, wherein said at least one positioning frame has side edges comprising bulges.

9. The heating device as claimed in claim 1, wherein the positioning frame is made from polyamide.

10. The heating device as claimed in claim 1, wherein the radiator element comprises a radiator sheet and a lamella element in the form of corrugation ribs.

11. The heating device as claimed in claim 10, wherein the radiator sheet comprises crimp lugs laterally molded thereon.

12. The heating device as claimed in claim 10, wherein the radiator sheet has its side edges turned up so that said lamella element can be fixed to the radiator sheet by snapping it in.

13. The heating device as claimed in claim 10, wherein the radiator sheet is provided at the front sides thereof with lamella terminating borders.

14. The heating device as claimed in claim 13, wherein at least one lamella terminating border is integrally connected to an electric terminal lug.

15. The heating device as claimed in claim 1, further comprising a holding frame including at least one spring bar and at least two side bars.

16. The heating device as claimed in claim 15, wherein the holding frame comprises springs connected to the spring bar.

17. The heating device as claimed in claim 15, wherein the holding frame comprises a substantially centrally located holding bar.

18. The heating device as claimed in claim 15, wherein the holding frame is provided at its ends with rotatable holding lugs.

19. Method for assembling a heating device, the method comprising the steps of:

connecting radiator sheets to lamella elements for prefabricating radiator elements;

clipping the prefabricated radiator elements and/or electrode sheets to positioning frames and inserting PTC elements for prefabricating radiator subassemblies;

stacking the prefabricated radiator subassemblies; and enclosing the stacked radiator subassemblies in a holding frame.

20. The method as claimed in claim 19, for assembling the heating device of any one of claims 1 to 18.

21. Positioning frame comprising:

means for receiving at least one PTC (Positive Temperature Coefficient) element; and means for clipping a radiator element to both sides of the positioning frame.

22. The positioning frame as claimed in claim 21, for use in the heating device of any one of claims 1 to 20.

23. A radiator subassembly comprising:

a radiator element; and a positioning frame clipped to the radiator element; the positioning frame comprising means for receiving at least one PTC (Positive Temperature Coefficient) element, and means for clipping said radiator element to both sides of the positioning frame.

24. The radiator subassembly as claimed in claim 23, for use in the heating device of any one of claims 1 to 20.

25. Heating device for heating air, the heating device comprising at least one radiator element and at least one positioning frame; said at least one positioning frame arranged for being fixed to said at least one radiator element; said at least one positioning frame comprising means for receiving at least one PTC (Positive Temperature Coefficient) element; said at least one positioning frame further comprising means for clipping a radiator element to at least one side of the positioning frame; said radiator element comprising a radiator sheet and a lamella element in the form of corrugation ribs.

26. The heating device as claimed in claim 25, wherein the radiator sheet comprises crimp lugs laterally molded thereon.

27. The heating device as claimed in claim 25, wherein the radiator sheet has its side edges turned up so that said lamella element can be fixed to the radiator sheet by snapping it in.

28. The heating device as claimed in claim 25, wherein the radiator sheet is provided at the front sides thereof with lamella terminating borders.

29. The heating device as claimed in claim 28, wherein at least one lamella terminating border is integrally connected to an electric terminal lug.

30. The heating device as claimed in claim 25, wherein said clipping means comprises at least one clip nose.

31. The heating device as claimed in claim 25, wherein said clipping means permits clipping to both sides of the positioning frame.

32. The heating device as claimed in claim 25, wherein said clipping means is also arranged for clipping to an electrode sheet.

33. The heating device as claimed in claim 32, wherein said electrode sheet comprises a terminal lug.

34. The heating device as claimed in claim 33, wherein the terminal lug is bent by substantially 90°.

35. The heating device as claimed in claim 32, wherein said electrode sheet is connected to a second electrode sheet via a bridge, thereby forming a two-part electrode element.

36. The heating device as claimed in claim 25, wherein said means for receiving at least one PTC element comprises at least one opening in the positioning frame.

37. The heating device as claimed in claim 25, wherein said at least one positioning frame has side edges comprising bulges.

38. The heating device as claimed in claim 25, wherein the positioning frame is made from polyamide.

39. The heating device as claimed in claim 25, further comprising a holding frame including at least one spring bar and at least two side bars.

40. The heating device as claimed in claim 39, wherein the holding frame comprises springs connected to the spring bar.

41. The heating device as claimed in claim 39, wherein the holding frame comprises a substantially centrally located holding bar.

42. The heating device as claimed in claim 39, wherein the holding frame is provided at its ends with rotatable holding lugs.

* * * * *